US008480070B2

(12) United States Patent
Abe

(10) Patent No.: US 8,480,070 B2
(45) Date of Patent: Jul. 9, 2013

(54) SCRAP STACKING APPARATUS AND SHEET PROCESSING APPARATUS

(75) Inventor: Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 409 days.

(21) Appl. No.: 12/959,751

(22) Filed: Dec. 3, 2010

(65) Prior Publication Data

US 2011/0154965 A1 Jun. 30, 2011

(30) Foreign Application Priority Data

Dec. 25, 2009 (JP) ..... 2009-295865

(51) Int. Cl.
*B26D 5/00* (2006.01)

(52) U.S. Cl.
USPC ..... 270/58.07; 270/52.17

(58) Field of Classification Search
USPC ..... 270/52.17, 58.07, 58.08; 83/73, 83/358, 359
See application file for complete search history.

(56) References Cited

U.S. PATENT DOCUMENTS 8,122,798 B1 * 2/2012 Shafer et al. ..... 83/62.1

FOREIGN PATENT DOCUMENTS

JP 2001-293691 10/2001

* cited by examiner

*Primary Examiner* — Leslie A Nicholson, III
(74) *Attorney, Agent, or Firm* — Fitzpatrick, Cella, Harper & Scinto

(57) ABSTRACT

A scrap stacking apparatus includes a stacking portion to which scraps, generated in processing portions that carry out processes on sheets, are stacked, an oscillation portion that is placed out of the stacking portion, and generates an electromagnetic wave, and a receiving portion that is placed out of the stacking portion, and receives the electromagnetic wave oscillated by the oscillation portion through the stacking portion, wherein the oscillation portion generates an electromagnetic wave in a band from 30 GHz to 100 THz, and the electromagnetic wave, oscillated by the oscillation portion, is received by the receiving portion through the stacking portion so that a stacked state of the scraps housed in the stacking portion is detected.

18 Claims, 13 Drawing Sheets

SCRAP STACKING APPARATUS AND SHEET PROCESSING APPARATUS

BACKGROUND OF THE INVENTION

1. Field of the Invention

The present invention relates to a scrap stacking apparatus that can stack scraps generated upon executing processes on sheets, and detect its stacked state, and a sheet processing apparatus provided with such a scrap stacking apparatus.

2. Description of the Related Art

Conventionally, various sheet processing apparatuses provided with a processing portion that carries out a predetermined process on a sheet on which an image is formed by an image forming apparatus have been proposed. For the processing portion, for example, a perforating portion for carrying out a perforating process on a sheet and a shearing portion for carrying out a shearing process on a sheet bundle that has been saddle-stitched and folded in the middle to be formed into a book have been known. In the sheet processing apparatus having such a processing portion, since sheet scraps are generated by the perforating portion and the shearing portion, a sheet scrap stacking apparatus used for stacking the sheet scraps is installed. In such a sheet scrap stacking apparatus, a sheet scrap detection device composed of an oscillation portion and a receiving portion for detecting a fully stacked state of the sheet scraps is installed, as disclosed in Japanese Patent Laid-Open No. 2001-293691. In this sheet scrap detection device, an electromagnetic wave, emitted by the oscillation portion, is directed into a dust box through an incident port for the electromagnetic wave formed on the dust box to be used for housing sheet scraps. When the dust box is fully filled with the sheet scraps, the electromagnetic wave that has been directed thereto is blocked by the sheet scraps to prevent it from reaching an exit port and the receiving portion so that the fully filled state of the sheet scraps is detected.

In the above-mentioned conventional art, however, the incident port and the exit port that allow the electromagnetic wave to pass therethrough need to be formed on the dust box. In the case where holes are formed as the incident and exit ports, there is a possibility that sheet scraps might leak through these holes to be scattered externally. In contrast, in the case where electromagnetic wave transmitting members are attached to the incident and exit ports, although scattering of sheet scraps outside the dust box can be prevented, sheet scraps that have been charged tend to adhere to the incident and exit ports, with the result that the fully stacked state might be detected prior to an actual fully filled state.

SUMMARY OF THE INVENTION

In view of the above problems, the present invention provides a scrap stacking apparatus that can prevent scraps from leaking outside and avoid an erroneous detection of the filled state of scraps.

In order to achieve the above-mentioned object, a scrap stacking apparatus according to the present invention includes a stacking portion to which scraps, generated in processing portions that carry out processes on sheets, are stacked, an oscillation portion that is placed out of the stacking portion, and generates an electromagnetic wave, and a receiving portion that is placed out of the stacking portion, and receives the electromagnetic wave oscillated by the oscillation portion through the stacking portion, wherein the oscillation portion generates an electromagnetic wave in a band from 30 GHz to 100 THz, and the electromagnetic wave, oscillated by the oscillation portion, is received by the receiving portion through the stacking portion so that a stacked state of the scraps housed in the stacking portion is detected.

Further features of the present invention will become apparent from the following description of exemplary embodiments with reference to the attached drawings.

DESCRIPTION OF THE EMBODIMENTS

In the following, embodiments of the present invention will be described in detail as examples with reference to the drawings. Here, dimensions, materials, shapes and relative arrangement of structural components described in the following embodiments may be appropriately modified according to apparatus configurations to which the present invention is applied and various conditions. Therefore, unless otherwise specified, the scope of the present invention is not to be limited thereto.

Figure 1:
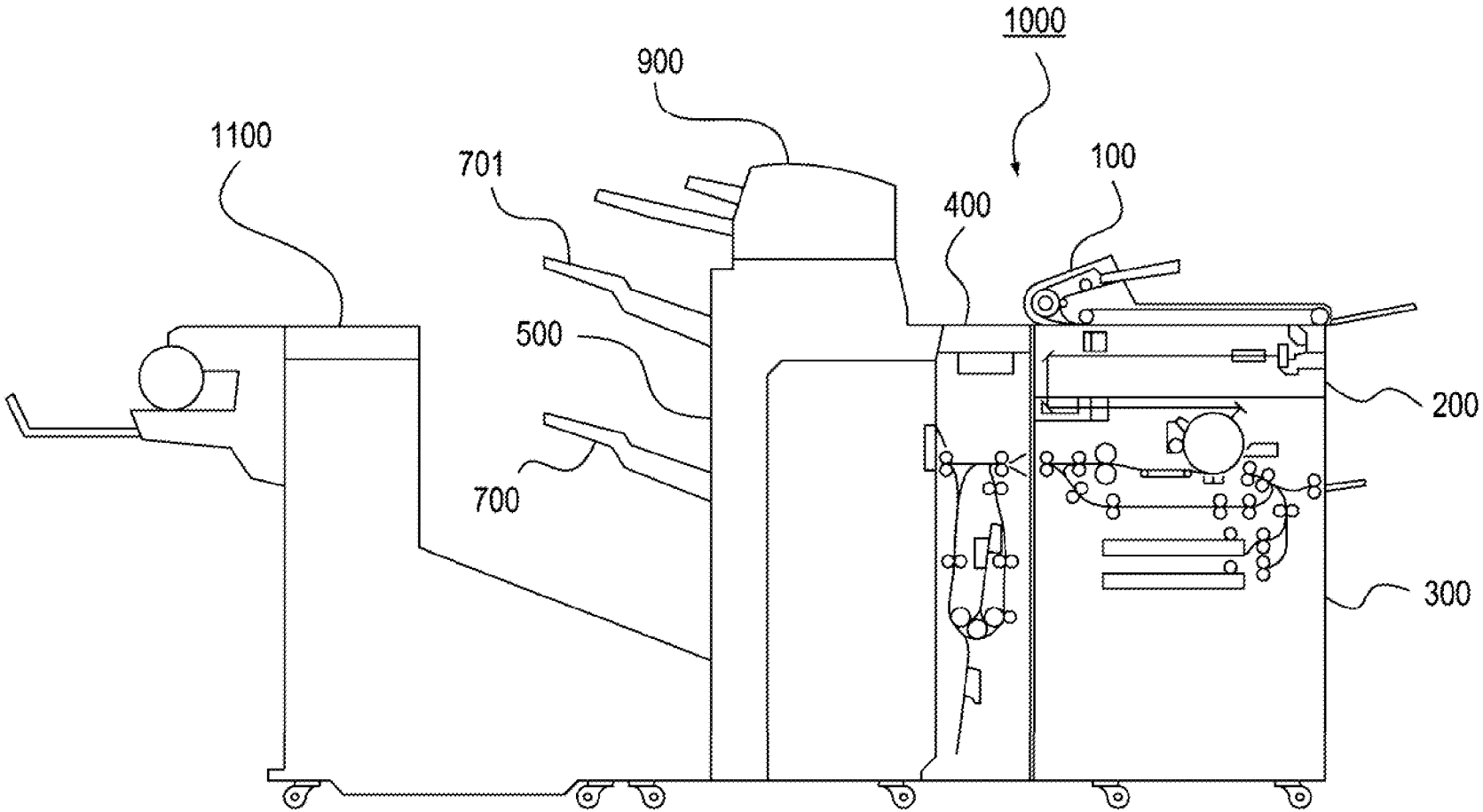
FIG. 1 is a longitudinal cross-sectional front view illustrating a sheet processing apparatus having a scrap stacking apparatus and an image forming apparatus.

First, referring to FIG. 1, the following description will discuss a sheet processing apparatus provided with a scrap stacking apparatus and the entire structure of an image forming apparatus. FIG. 1 is a cross-sectional view illustrating an inner configuration of a copying apparatus 1000 serving as an image forming apparatus to which the sheet processing apparatus is applicable.

The copying apparatus 1000 includes a document feeding portion 100, an image reader portion 200, a printer portion 300, a fold processing portion 400, a finisher 500, an inserter 900, a trimmer portion 1100, and the like. The fold processing portion 400, the inserter 900, the trimmer portion 1100 and the like can be installed as optional devices.

The document feeding portion 100 is used for successively feeding documents sheet by sheet toward an image reading position of the image reader portion 200. The image reader portion 200 reads the image of the document. The printer portion 300 forms an image on a sheet based on the image information of the document thus read in the image reader portion 200, or image information that has been sent thereto.

The finisher 500 captures sheets bearing images formed thereon from the printer portion 300, and arranges a plurality of sheets thus captured so as to bind them as one sheet bundle. Moreover, this also carries out a stapling process (binding process) in which the rear end of the sheet bundle is stapled and a perforating process in which the rear end of the sheet bundle is also perforated. Moreover, this further carries out sheet processes, such as a sorting process, a non-sorting process and a saddle-stitch bookbinding process.

Figure 2:
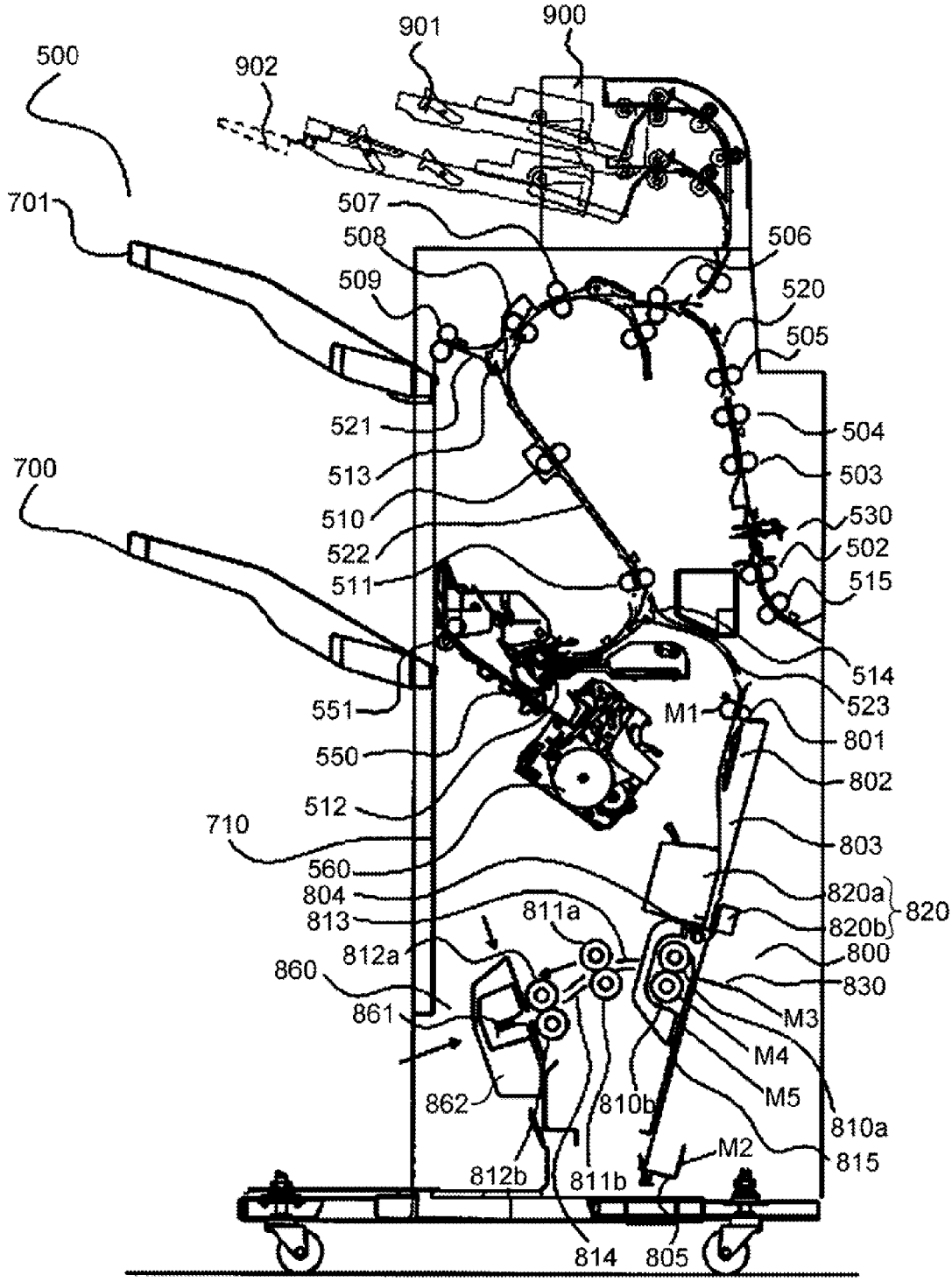
FIG. 2 is a longitudinal cross-sectional front view illustrating the sheet processing apparatus.
Figure 3A:
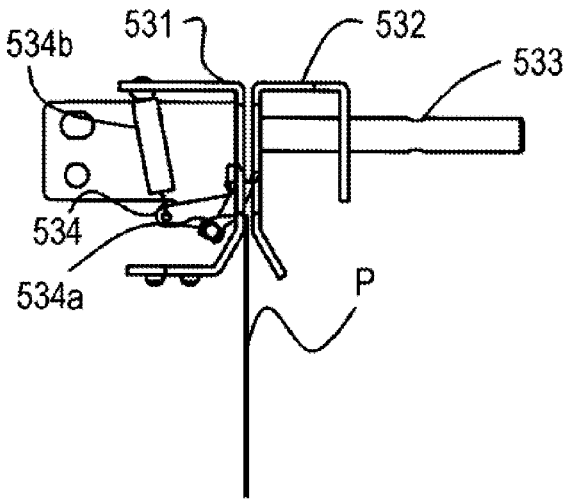
FIGS. 3A to 3D are cross-sectional views of a punch unit.
Figure 3B:
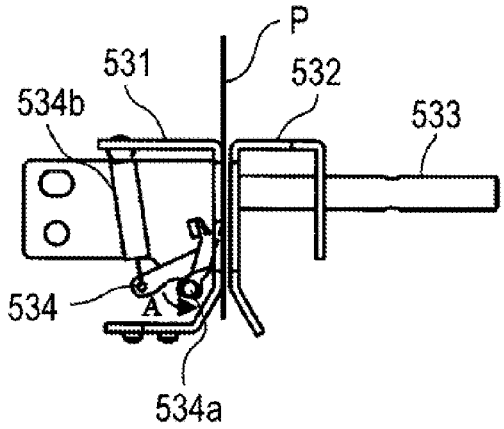
Figure 3C:
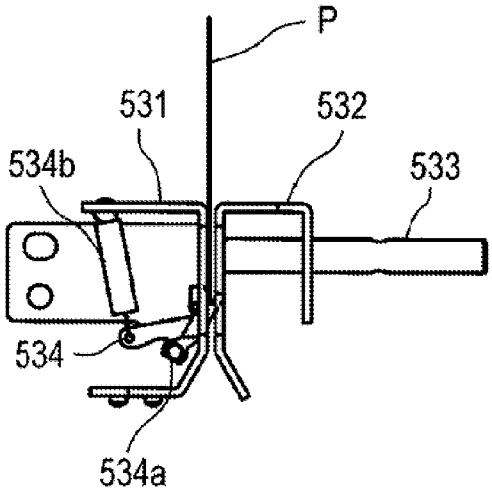
Figure 3D:
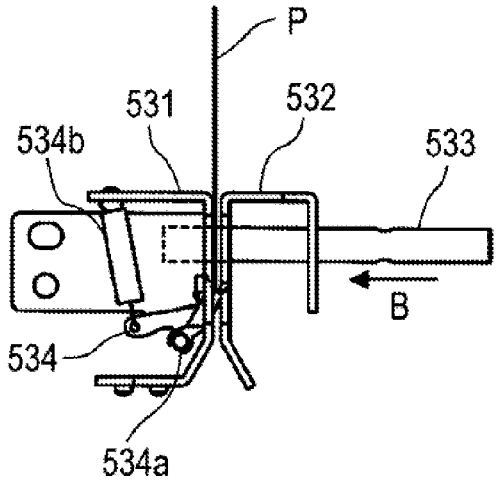

The following description will discuss a configuration of the sheet processing apparatus together with a flow of the sheet. As illustrated in FIG. 2, the finisher 500 is provided with a conveying path 520 used for capturing sheets conveyed through the fold processing portion 400 to the inside of the device, and in the conveying path 520, pairs of conveying rollers 502 to 508 are installed successively from a pair of inlet rollers 515. A punch unit 530 serving as the perforating portion is installed between the pair of conveying rollers 502 and the pair of conveying rollers 503. The punch unit 530 carries out operations on demand, and executes a punching process (perforating process) on the rear end of the sheet conveyed thereto. A switching member 513, placed on the rear end of the conveying path 520 located on the downstream side of the punching processing portion, is used for switching paths between an upper discharge path 521 and a lower discharge path 522 that connect to the downstream side. The upper discharge path 521 carries out a discharging process onto a stack tray 701 by using a pair of upper discharging rollers 509. On the other hand, the lower discharge path 522 is provided with a pair of conveying rollers 510, 511 and 512, and carries out a discharging process onto a processing tray 550. Sheets, which are discharged onto the processing tray 550, are housed in the form of bundles, while being successively subjected to arranging processes, and according to settings given by the operation portion 1 (see FIG. 11), a sorting process and a stapling process are carried out thereon. Thereafter, the sheet bundles are selectively discharged onto stack trays 700 and 701 by a pair of bundle discharging rollers 551.

The stapling process is carried out by the stapler 560 serving as the binding portion. The stapler 560 is allowed to shift in a width direction orthogonal to the sheet conveying direction so that the stapling process is executed at a desired position of the sheet bundle. The stack trays 700 and 701 are designed to be shiftable in upper and lower directions. The upper stack tray 701 can receive sheets from the upper discharge path 521 and the processing tray 550, and the lower stack tray 700 can receive sheets from the processing tray 550. In this manner, a large amount of sheets or a large amount of sheet bundles can be stacked on the stack trays 700 and 701 so that the sheets or sheet bundles stacked thereon are arranged, with their rear ends being regulated by a rear end guide 710 that extends longitudinally.

The following description will discuss a structure of a saddle-stitch bookbinding portion 800 in the finisher. Sheets, whose conveying path is switched to a saddle discharge path 523 by the switching member 514 installed in the middle of the lower discharge path 522, are sent to the saddle-stitch bookbinding portion 800. The sheets are received by a pair of saddle inlet rollers 801, and conveyed into a housing guide 803 of the saddle-stitch bookbinding portion 800, with the conveying inlet thereof being selected by a switching member 802 that is operated by a solenoid depending on sizes. The sheets thus conveyed therein are further conveyed by a sliding roller 804 until the tips thereof have been made in contact with a movable sheet positioning member 805. The pair of saddle inlet rollers 801 and the sliding roller 804 are driven by a motor M1. Moreover, in the mid position of the housing guide 803, a stapler 820, which serves as a binding portion, and whose divided portions are disposed to be opposed to each other with the housing guide 803 interposed therebetween, is installed. The stapler 820 is divided into a driver 820*a* that pushes needles out and an anvil 820*b* that bends the protruded needles. Additionally, upon conveying a sheet therein, the sheet positioning member 805 is stopped at a position that allows the center portion in the sheet conveying direction to be coincident with the binding position of the stapler 820. The sheet positioning member 805 is freely shifted upon being driven by the motor M2, and changes its position depending on the sheet sizes and the like.

A pair of folding rollers 810*a* and 810*b* is placed on the downstream side of the stapler 820, and a protruding member 830 is installed at an opposed position between the pair of folding rollers 810*a* and 810*b*. The protruding member 830 has a position retracted from the housing guide 803 as a home position. The protruding member 830, driven by a motor M3, protrudes toward a sheet bundle thus housed so that the sheet bundle is folded while being pushed into a nip of the pair of folding rollers 810*a* and 810*b*. Thereafter, the protruding member 830 again returns to its home position. Additionally, a pressure F1 that is sufficient to put a fold to the bundle is applied between the pair of folding rollers 810 from a spring, not illustrated. The bundle with the fold put thereon is conveyed by a pair of first fold conveying rollers 811*a*, 811*b* and a pair of second fold conveying rollers 812*a*, 812*b*. Pressures F2 and F3 that are sufficient to convey and stop the bundle with the fold put thereon are also applied to the pair of first fold conveying rollers 811 and the pair of second fold conveying rollers 812.

A conveying guide 813 is a conveying guide that connects the pair of folding rollers 810 and the pair of first fold conveying rollers 811 with each other. A conveying guide 814 is a conveying guide that connects the pair of first fold conveying rollers 811 and the pair of second fold conveying rollers 812. In this case, the pair of folding rollers 810, the pair of first fold conveying rollers 811 and the pair of second fold conveying rollers 812 are rotated at a uniform velocity by the same motor M4 (not illustrated).

The folding operations of the sheet bundle bound by the stapler 820 are executed after the sheet positioning member 805 has been lowered from the position relating to the stapling process by a predetermined distance after the completion of the stapling process so as to make the stapled position of the sheet bundle coincident with the nip position of the pair of folding rollers 810. Thus, the sheet bundle can be folded at the position that has been subjected to the stapling process.

A pair of alignment plates 815 serves as an aligning portion that aligns sheets housed in the housing guide 803, and has protruding faces into the housing guide 803, with the peripheral surfaces of the pair of folding rollers 810*a* and 810*b* being sandwiched in between. The pair of alignment plates 815 carries out a positioning process in the sheet width direction by moving in sandwiching directions relative to the sheets, when driven by a motor M5.

A fold press unit 860 is installed on the downstream side of the pair of second fold conveying rollers 812. The fold press unit 860 has a press holder 862 that supports pair of press rollers 861, and by shifting the press holder 862 in the direction of the fold, with the fold being nipped by the pair of press rollers 861, the fold is strengthened.

The inserter 900 is used for supplying sheets set in insert trays 901 and 902 by the user toward either the stack trays 701 and 700, or the saddle-stitch bookbinding portion, without passing them through the printer portion 300. The sheet bundle, stacked on the insert trays 901 and 902, are successively separated sheet by sheet, and allowed to join to the conveying path 520 at a desired timing.

Figure 11:
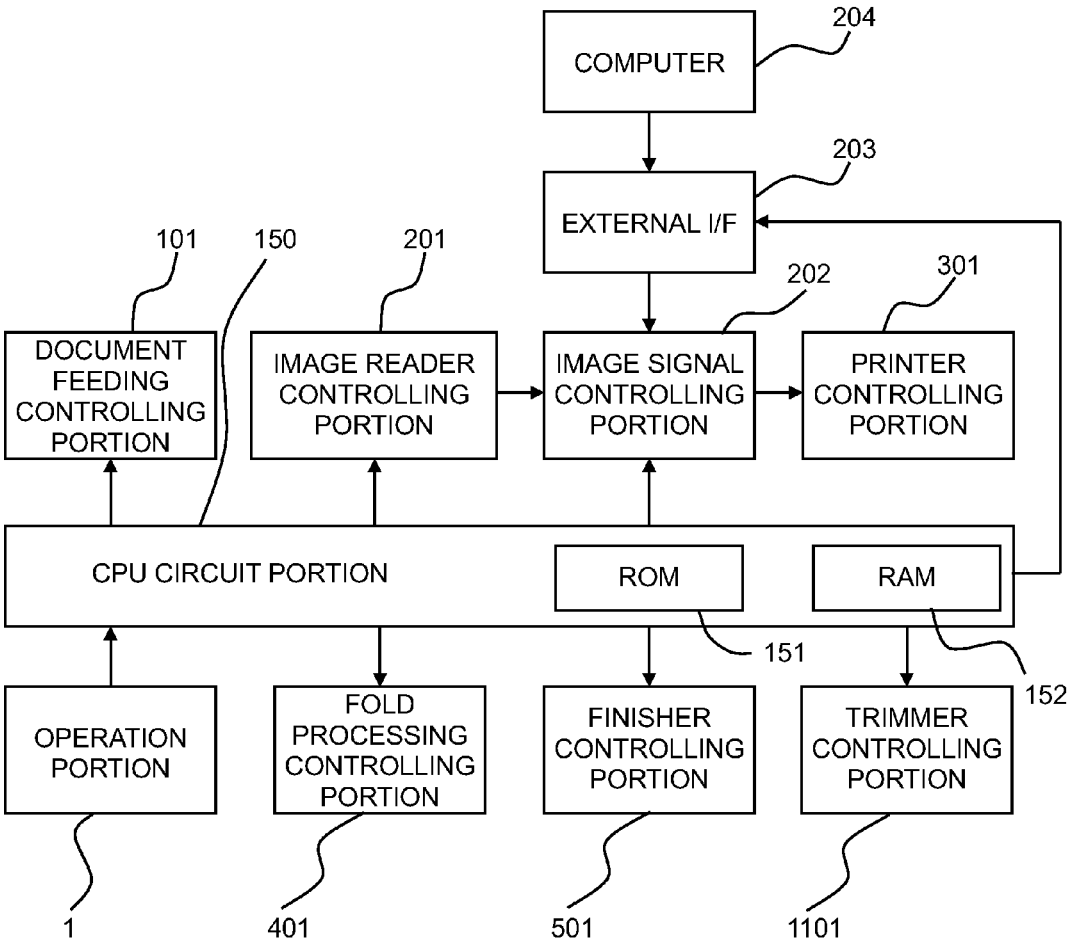
FIG. 11 is a block diagram relating to controlling operations of the entire apparatus.

FIG. 11 is a block diagram illustrating a copying apparatus 1000. A CPU circuit portion 150 includes a CPU (not illustrated), and controls the following portions according to settings of a control program stored in a ROM 151 and the operation portion 1. That is, the CPU circuit portion 150 controls a document feeding controlling portion 101, an image reader controlling portion 201, an image signal controlling portion 202, a printer controlling portion 301, a fold processing controlling portion 401, a finisher controlling portion 501, a trimmer controlling portion 1101, and an external I/F 203. The document feeding controlling portion 101 controls a document feeding portion 100. The image reader controlling portion 201 controls an image reader portion 200. The printer controlling portion 301 controls a printer portion 300. The fold processing controlling portion 401 controls a fold processing portion 400. The finisher controlling portion 501 controls the finisher 500, the saddle-stitch bookbinding portion 800 and the inserter 900. The operation portion 1 includes a plurality of keys for use in setting various functions relating to image formation, a display portion that displays setting states, and the like. The operation portion 1 outputs a key signal corresponding to each key operation by the user to the CPU circuit portion 150, and displays corresponding information based on a signal from the CPU circuit portion 150.

The RAM 152 is used as an area for temporarily storing control data and a working area for operations relating to a controlling process. The external I/F 203 is an interface between the copying apparatus 1000 and an external computer 204, and develops print data from the computer 204 into a bit-mapped image, and outputs the image to the image signal controlling portion 202 as image data. Moreover, from the image reader controlling portion 201 to the image signal controlling portion 202, an image of a document, read by the image sensor (not illustrated), is output. The printer controlling portion 301 outputs image data received from the image signal controlling portion 202 to an exposure controlling portion (not illustrated).

Figure 4A:
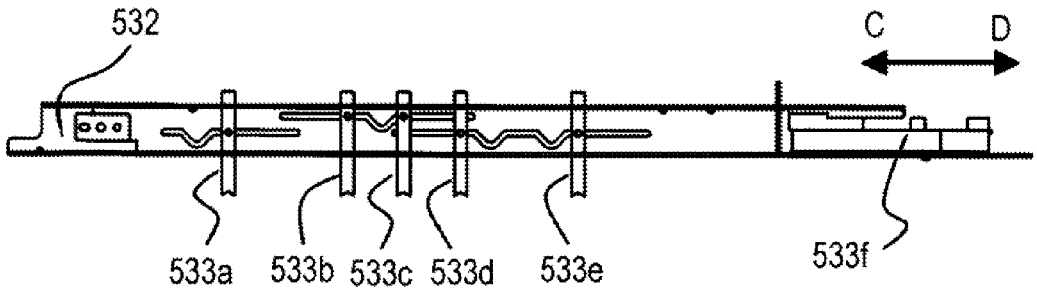
FIGS. 4A to 4C are cross-sectional views of a punch die.
Figure 4B:
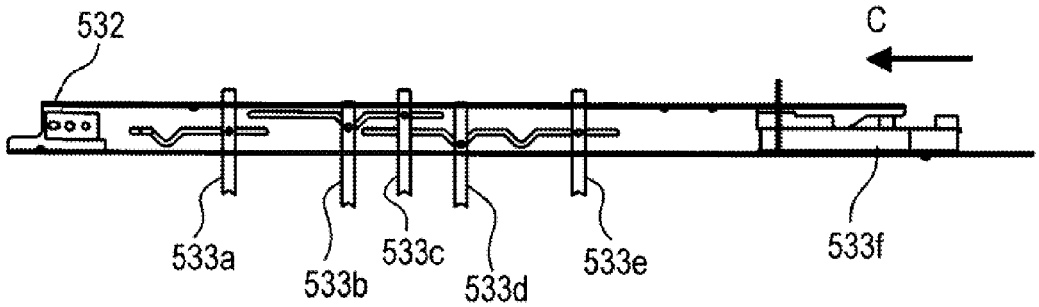
Figure 4C:
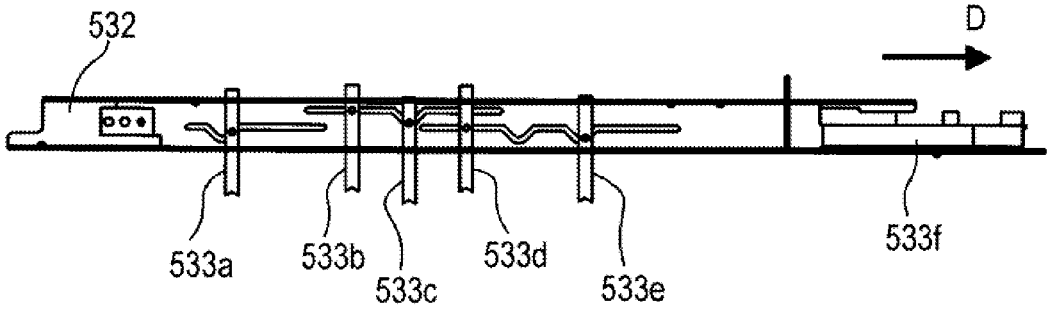

FIG. 3 is a cross-sectional view illustrating the punch unit 530. When a sheet P passes between the conveying paths 531 and 532, a rear end stopper 534 retracts in an arrow A direction centered on a rear-end stopper rotating axis 534*a* as a rotating center by a conveying force of the pairs of conveying rollers 502 and 503, as illustrated in FIG. 3B. Thereafter, when the rear end of the sheet P exceeds the rear end stopper 534, the rear end stopper 534 is returned to the position of FIG. 3A by a force of a rear end stopper biasing spring 534*b*. Then, the sheet P is switch-backed by an inverting action of the pair of conveying rollers 503 and stopped after the sheet rear end has been abutted against the rear end stopper 534, as illustrated in FIG. 3C. The sheet P, which has been subjected to a positioning process for perforation, is then perforated at a predetermined position, by an action of a punch die 533 in an arrow B direction as illustrated in FIG. 3D. FIG. 4 illustrates operations of the punch die 533. As illustrated in FIG. 4A, the punch die 533 includes dies 533*a* to 533*e* and a punch rack 533*f*. As illustrated in FIG. 4B, when the punch rack 533*f* moves in an arrow C direction, punching processes for two punch holes are carried out by the dies 533*b* and 533*d*. On the other hand, as illustrated in FIG. 4C, when the punch rack 533*f* moves in an opposite arrow D direction, punching processes for three punch holes are carried out by the dies 533*a*, 533*c* and 533*e*. In this manner, the punch unit 530 serving as the perforating portion includes at least one or more perforation patterns. In this case, two patterns are exemplified as a perforation pattern; however, the number of the perforation patterns is not limited to this, and the number is preferably determined on demand.

Figure 5A:
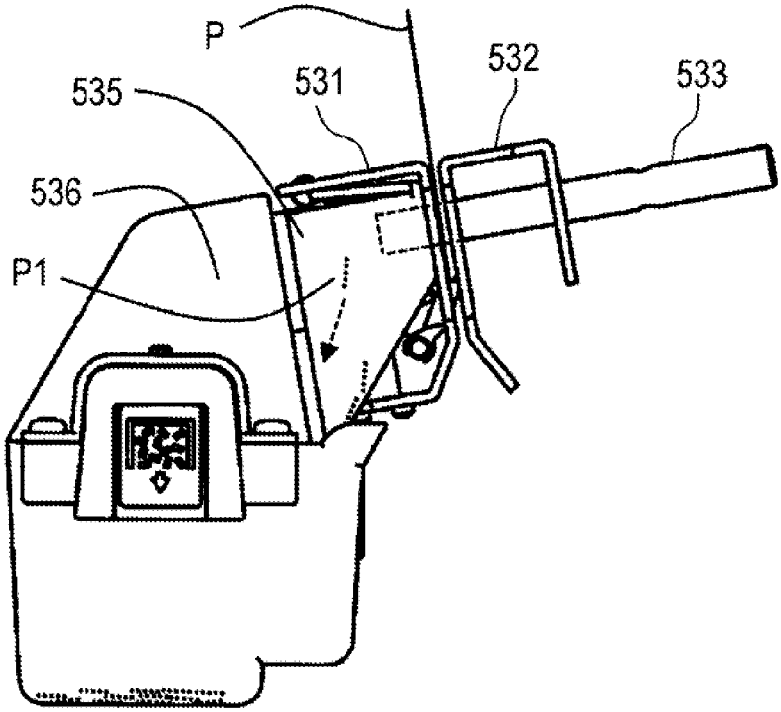
FIG. 5A is a longitudinal cross-sectional front view illustrating the punch unit and a scrap box.
Figure 5B:
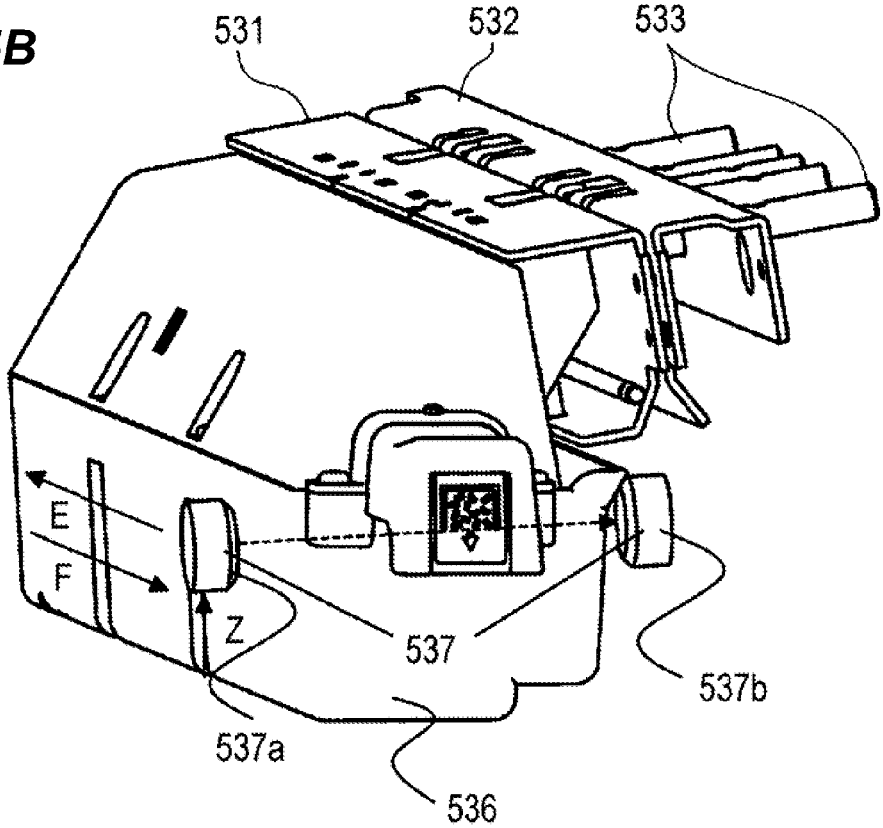
FIG. 5B is a perspective view illustrating the punch unit and the scrap box.

Punch scraps (perforation scraps) as cut scraps generated upon carrying out punching operations as described above are stacked onto a scrap stacking apparatus, which is described below. Referring to FIGS. 5A and 5B, the following description will discuss the scrap stacking apparatus more specifically.

As illustrated in FIG. 5A, punch scraps P1, generated upon carrying out punching operations as described above, are conveyed through a punch scrap conveying duct 535, and housed in a punch scrap box 536 serving as a stacking portion. By repeating these operations, scraps are stored in the punch scrap box 536. As illustrated in FIG. 5B, punch scrap detection portions 537 are installed on two sides (outside) of the punch scrap box 536 at a predetermined height z from the box bottom.

The punch scrap detection portion 537 includes an oscillation portion 537*a* that oscillates an electromagnetic wave in a band from 30 GHz to 100 THz, and a receiving portion 537*b*. These portions are disposed face to face with each other with the punch scrap box 536 interposed therebetween, and every time the punching processes are carried out a predetermined number of times, a scanning operation is executed in an arrow E direction. When, after the scanning operation, the punching processes have been again carried out the predetermined number of times, the scanning operation is executed in an opposite arrow F direction this time. Every time the punching processes (perforating process) have been carried out the predetermined number of times, the above-mentioned scanning operation is repeated. Upon scanning, the electromagnetic wave, oscillated from the oscillation portion 537*a*, is transmitted through the punch scrap box 536, and at this time, the amplitude is attenuated. Moreover, the amplitude is also attenuated by the punch scraps P1 located inside the punch scrap box 536. By detecting the attenuated electromagnetic wave by the receiving portion 537*b*, the stacked amount of scraps (stacked state of cut scraps) inside the punch scrap box 536 is detected in a direction connecting the oscillation portion 537*a* and the receiving portion 537*b*.

More specifically, the oscillation portion 537*a* oscillates a continuation electromagnetic wave. Then, the attenuation of the amplitude of the electromagnetic wave which occurs when penetrating through the punch scrap box 536 and the punch scrap P1 is received by the receiving portion 537*b*. Thus, the stacked state of the punch scrap P1 stacked into the punch scrap box 536 (stacked state of punch scraps located between the oscillation portion 537*a* and the receiving portion 537*b*, and stacked state of punch scraps in a scanning direction from the oscillation portion 537*a* to the receiving portion 537*b*) can be detected.

Moreover, the punch scrap box 536 serving as a stacking portion is made from a material such as plastics that allow the electromagnetic wave oscillated by the oscillation portion 537*a* to transmit therethrough.

Figure 6A:
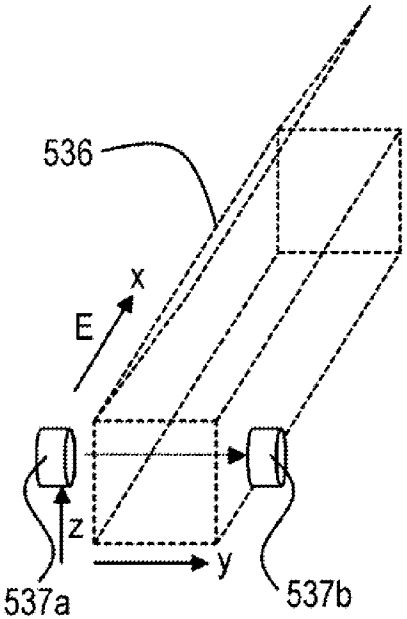
FIG. 6A is a perspective view illustrating the scrap box without scraps stacked therein.
Figure 6B:
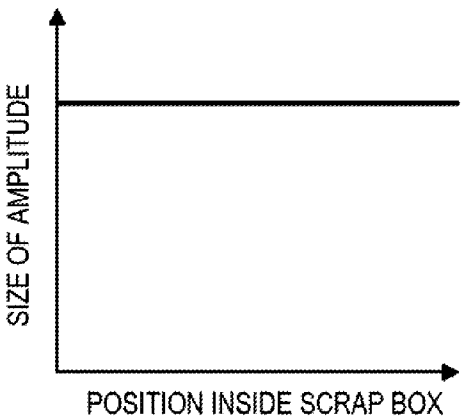
FIG. 6B is a drawing illustrating the results of detection of the inside of the scrap box without scraps stacked therein.
Figure 6C:
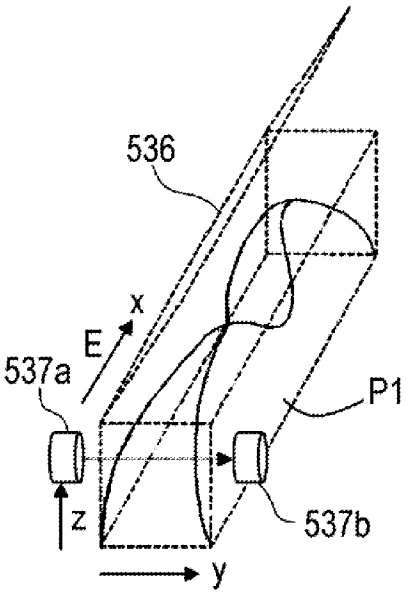
FIG. 6C is a perspective view illustrating the scrap box with scraps stacked therein.
Figure 6D:
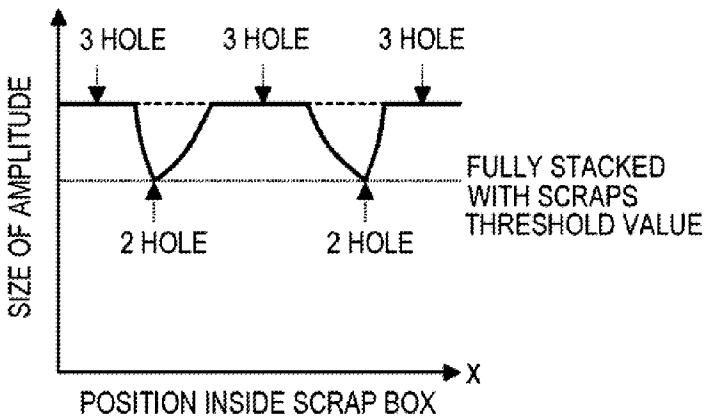
FIG. 6D is a drawing illustrating the results of detection of the inside of the scrap box with scraps stacked therein.
Figure 8B:
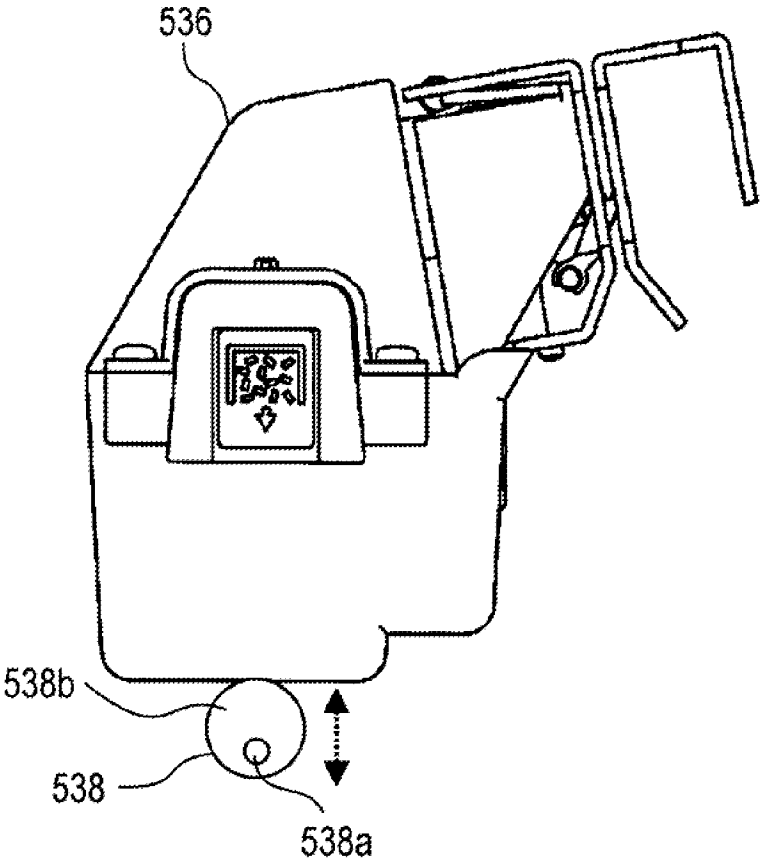
FIGS. 8A and 8B are longitudinal cross-sectional front views that illustrate a vibrating portion.
Figure 8A:
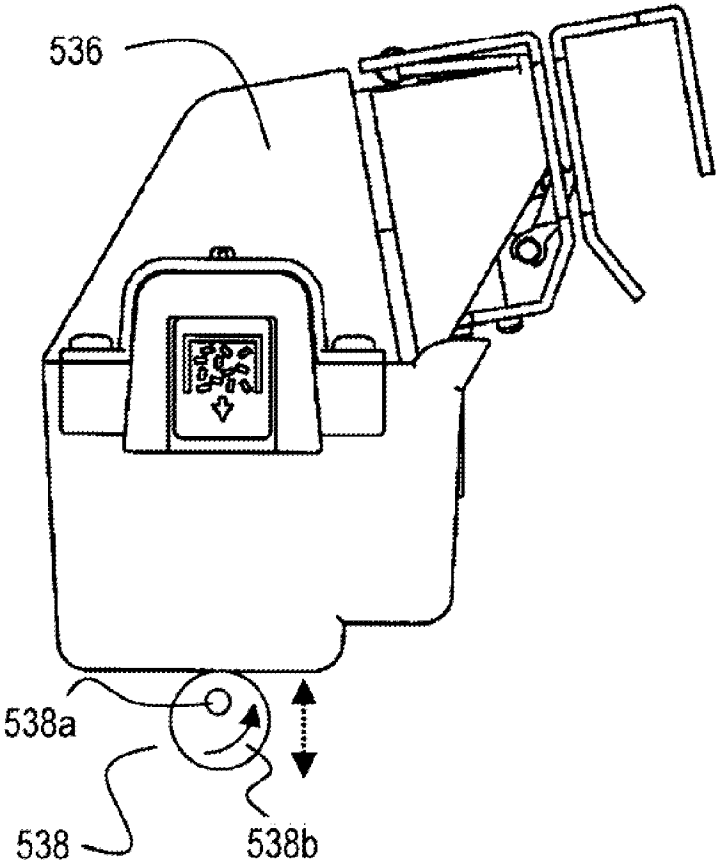

The following description will discuss processes that are carried out upon detecting the stacked amount of punch scraps P1. As illustrated in FIG. 6A, the punch scrap box 536 in an empty state is preliminarily scanned by the punch scrap detection portion 537 so that a waveform (empty stacked state) is stored. FIG. 6B is a graph that indicates a relationship between the amplitude amount of the detected waveform and the depth direction value (scanning direction) x. FIG. 6C illustrates a state in which punching processes are then carried out so that scraps are stacked. FIG. 6C illustrates a state in which punch scraps, generated by two punch holes of the dies 533*b* and 533*d* (see FIG. 4B), are stacked. The electromagnetic wave that has propagated into the punch scrap box 536 is transmitted through the punch scraps P1 so that the amplitude thereof is attenuated. The amount of attenuation changes depending on the length in the lateral direction y of the punch scraps P1. That is, as the scraps exist in a plugged state in the lateral direction y, the amount of attenuation of the electromagnetic wave becomes greater. In FIG. 6D, in the case where the electromagnetic wave is transmitted through the punch scraps P1 stored by two hole punching processes, the amount of attenuation of the electromagnetic wave becomes greater, in comparison with the empty state, while the amount of amplitude becomes smaller. At this time, FIG. 8 illustrates that, at a place where the punch scraps P1 are stacked in a plugged state, the amount of attenuation of the electromagnetic wave becomes greater. As the results of the above-mentioned detection, the stacked state of punch scraps inside the punch scrap box 536 can be detected, and at the time when the amount of attenuation, detected by the punch scrap detection portion 537 installed at the predetermined height z, has reached a threshold value of a stacked state of scraps, the punching process is suspended (see FIG. 6D). At this time, in the state as illustrated in FIG. 6D, although the threshold value of a filled state of scraps in the two hole position has been reached, there is still some room for stacking in the three hole position so that punching processes for the three holes are made operable.

Figure 7A:
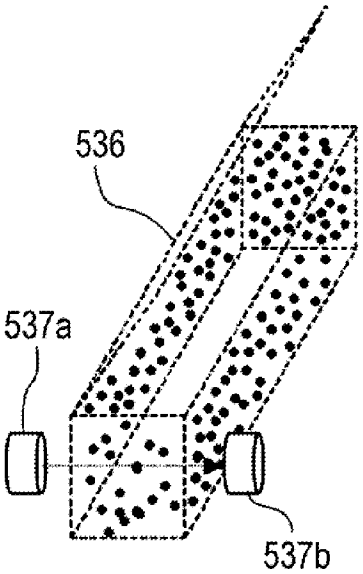
FIG. 7A is a perspective view illustrating a scrap box with scraps adhering to an inner wall.
Figure 7B:
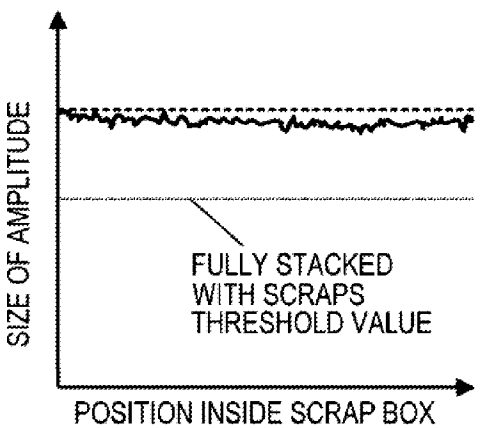
FIG. 7B is a drawing illustrating the results of detection of the inside of the scrap box with scraps adhering to the inner wall.

Moreover, even in the case where punch scraps P1 have adhered to the inner wall face of the punch scrap box 536, as illustrated in FIG. 7A, the plugged state in the lateral direction y can be detected based on the amount of attenuation of the electromagnetic wave by using the present detection method. That is, even in a state as illustrated in FIG. 7A, since the resulting waveform has not reached the threshold value of a filled state of scraps as illustrated in FIG. 7B, the job can be continued.

Figure 7C:
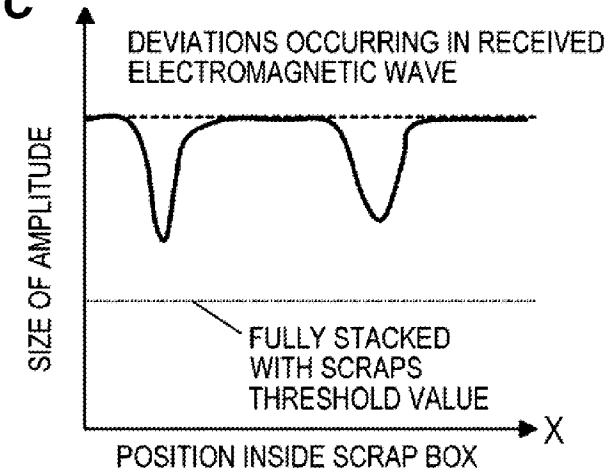
FIG. 7C is a drawing illustrating the results of detection of the inside of the scrap box, with stacked scraps being formed into a dome shape.
Figure 9:
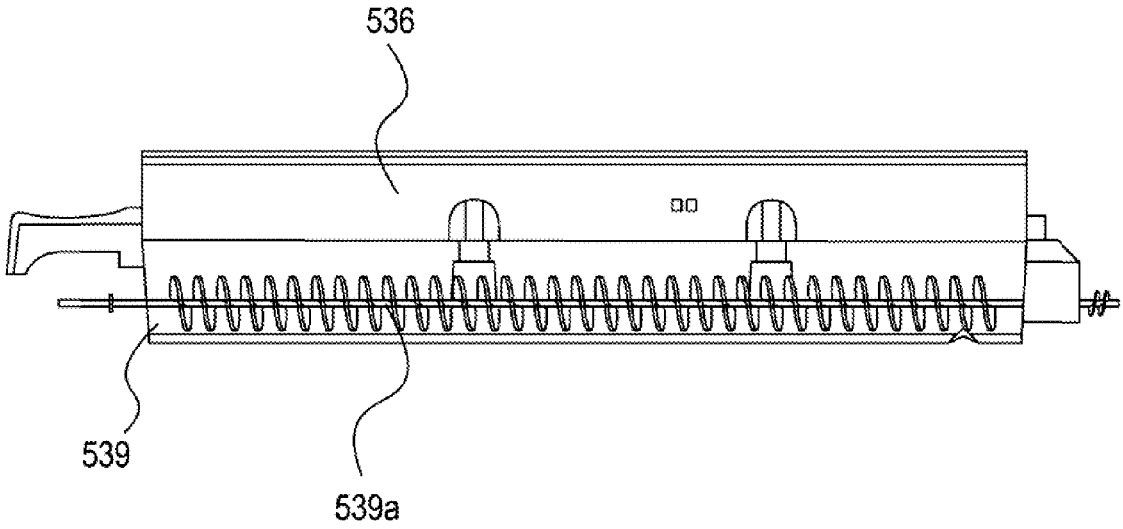
FIG. 9 is a longitudinal cross-sectional right-side view of a stirring portion.

Moreover, the scrap stacking apparatus includes a vibrating portion (see FIG. 8) or a stirring portion (see FIG. 9) so as to level the punch scraps stacked into the punch scrap box 536. In the case where the amplitude of the received electromagnetic wave has deviations that exceed a predetermined amount, the vibrating portion or the stirring portion is operated so as to level the stacked punch scraps into a flat state. More specifically, in the case where the amplitude of the electromagnetic wave received by the receiving portion 537*b* has deviations exceeding a predetermined amount, as illustrated in FIG. 7C, it is determined that punch scraps P1 in the punch scrap box 536 have been stacked to form a dome shape. In this case, the vibrating portion illustrated in FIG. 8 or the stirring portion illustrated in FIG. 9 (viewed from the right) is operated so that the punch scraps P1 stacked in the punch scrap box 536 are flattened.

The vibrating portion 538 illustrated in FIG. 8 is configured by a cam 538*a* and a cam rotation center 538*b*. The cam 538*a* rotates centered on the cam rotation center 538*b*, and by the rotation, the punch scrap box 536 is vibrated up and down so that the punch scraps P1 are flattened. The stirring portion 539, illustrated in FIG. 9, includes a screw 539*a*. In the same manner as in the vibrating portion, upon determination that the punch scraps P1 have been stacked to form a dome shape, the screw 539*a* is rotated so that the punch scraps are flattened, and the punching processes by the punch unit 530 are continuously carried out.

Figure 7D:
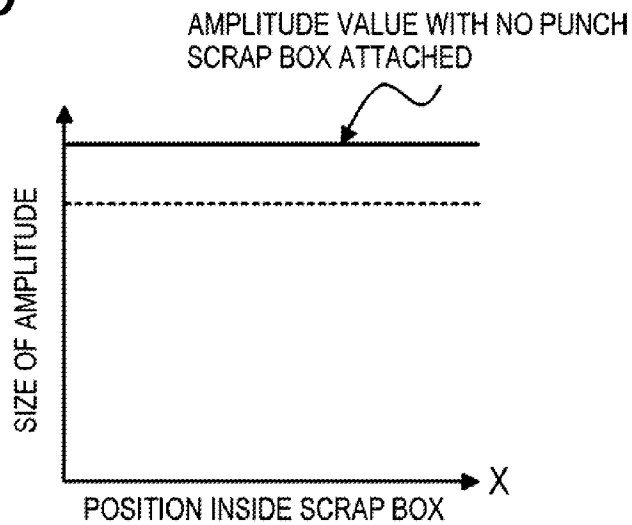
FIG. 7D is a drawing illustrating the results of detection of the inside of the scrap box in a non-attached state.

Moreover, the punch scrap box 536 is detachably attached to the apparatus main body. With this structure, in the case where the punch scrap box 536 is completely filled with punch scraps stacked therein, the punch scrap box 536 can be exchanged. Moreover, in a non-attached state of the punch scrap box 536, since no attenuation of electromagnetic wave (amplitude) is generated by the punch scrap box 536, the amplitude value of the detected electromagnetic wave becomes greater than the stored amplitude value, as illustrated in FIG. 7D. As a result, the non-attached state of the punch scrap box 536 can be recognized. The present embodiment exemplifies a structure in which one punch scrap detection portion 537 constituted by the oscillation portion 537*a* and the receiving portion 537*b* is installed; however, the number of installed scrap detection portions and the installed places may be appropriately set on demand, and the present invention is not intended to be limited to these. For example, by additionally installing a plurality of scrap detection portions in the height direction z as illustrated in FIG. 6C, the stacked state of scraps in the punch scrap box 536 can be detected in more detail.

Figure 10:
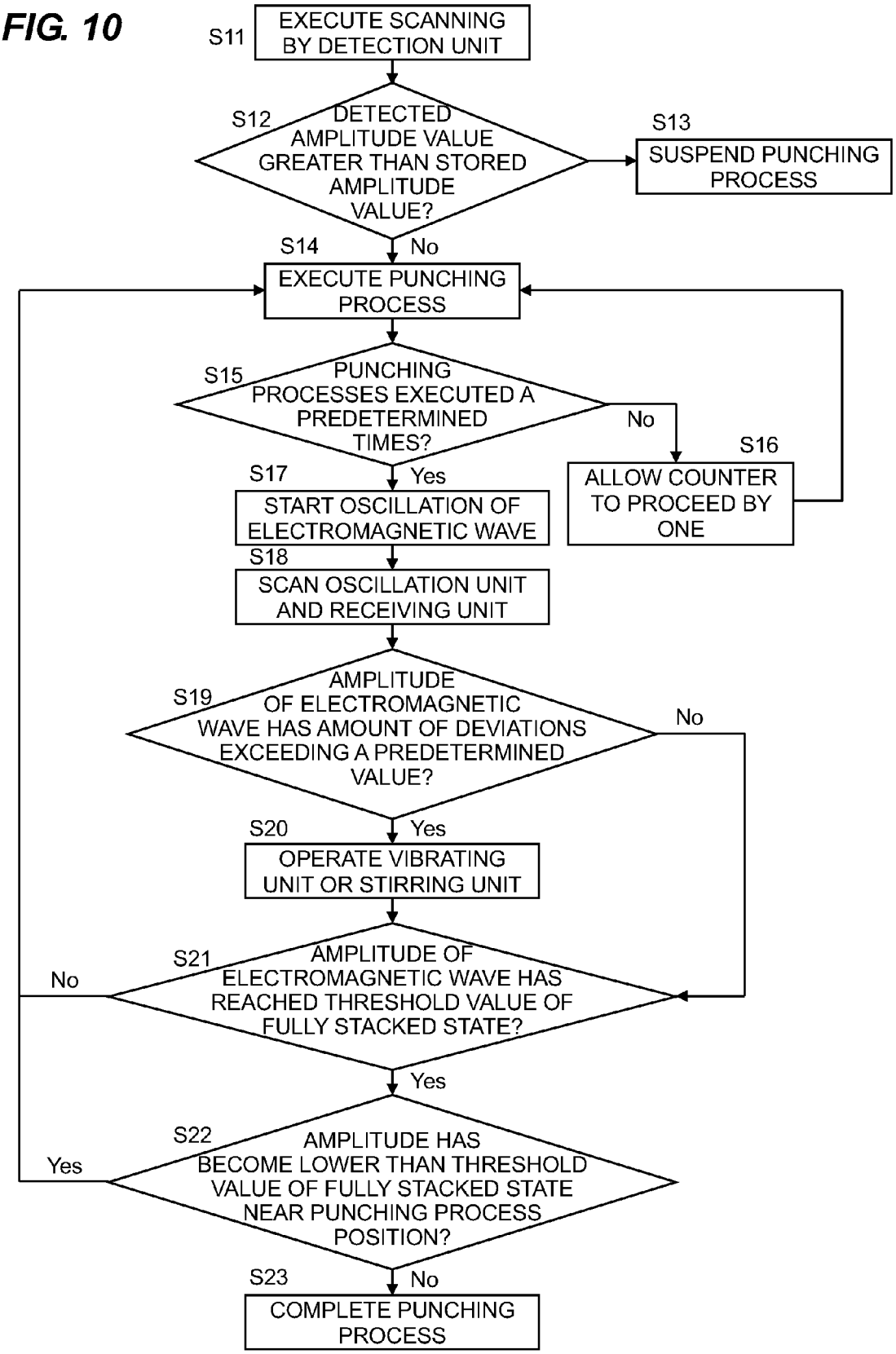
FIG. 10 is a flow chart illustrating punching processes.

FIG. 10 is a flow chart illustrating processing operations of the punch unit and the scrap stacking apparatus. First, the punch scrap detection portion carries out a scanning operation (step S11), and in the case where, in step S12, the amplitude value of the detection result is greater than the amplitude value (empty stacked state) stored, it is determined that the punch scrap box 536 is not attached, and the punching process is suspended (step S13). In contrast, in the case where, in step S12, the amplitude value of the detection result is smaller than the stored amplitude value, it is determined that the punch scrap box 536 is attached, the punching process is carried out (step S14). Thereafter, in step S15, it is determined whether the punching processes (perforating processes) have been carried out a predetermined number of times, and in the case where the processes have not been carried out the predetermined number of times, the counter of the number of punching processes is advanced by one (step S16), and the punching process is again carried out (step S14). In contrast, in the case where the punching processes have been carried out the predetermined number of times in step S15, the oscillation of electromagnetic wave in the oscillation portion 537*a* is started, and the counter is reset (step S17). Thereafter, both of the oscillation portion 537*a* and the receiving portion 537*b* are moved so that the scanning process is carried out on the punch scrap box 536 (step S18). In step S19, it is determined whether the amplitude of the electromagnetic wave detected by the scanning process has a quantity of deviations exceeding a predetermined value. In this case, a difference between the maximum value (small amount of scraps) and the minimum value (large amount of scraps) in the amplitude of the electromagnetic wave detected by the scanning process is found, and it is determined whether the difference thus found is a preliminarily set value (predetermined amount of deviations) or more. In the case where the amplitude of the detected electromagnetic wave is the predetermined amount of deviations or more, the vibrating portion 538 or the stirring portion 539 is operated (step S20). In contrast, in the case where the amplitude of the detected electromagnetic wave is less than the predetermined amount of deviations, the processing proceeds to step S21. In step S21, it is determined whether the amplitude of the electromagnetic wave has reached the threshold value (predetermined amount) of a filled state of scraps. When the amplitude of the electromagnetic wave has not reached the threshold value of a filled state of scraps in step S21, the processing proceeds to step S14, and the punching process is again carried out. In contrast, in the case where the amplitude of the electromagnetic wave has reached the threshold value of a filled state of scraps in step S21, it is determined whether the amount of stacked scraps is below the threshold value of a filled state of scraps near the position where the punching process is currently being carried out (step S22). If, in step S22, the amount of stacked scraps is below the threshold value of a filled state of scraps near the position where the punching process is currently being carried out (Yes), there is still some room for stacking scraps; therefore, the processing proceeds to step S14, and the punching process is again carried out. If, in step S22, the amount of stacked scraps is not below the threshold value of a filled state of scraps near the position where the punching process is currently being carried out (No), it is determined that the punch scraps P1 have been fully stacked, and the punching process is completed (step S23).

Figure 12:
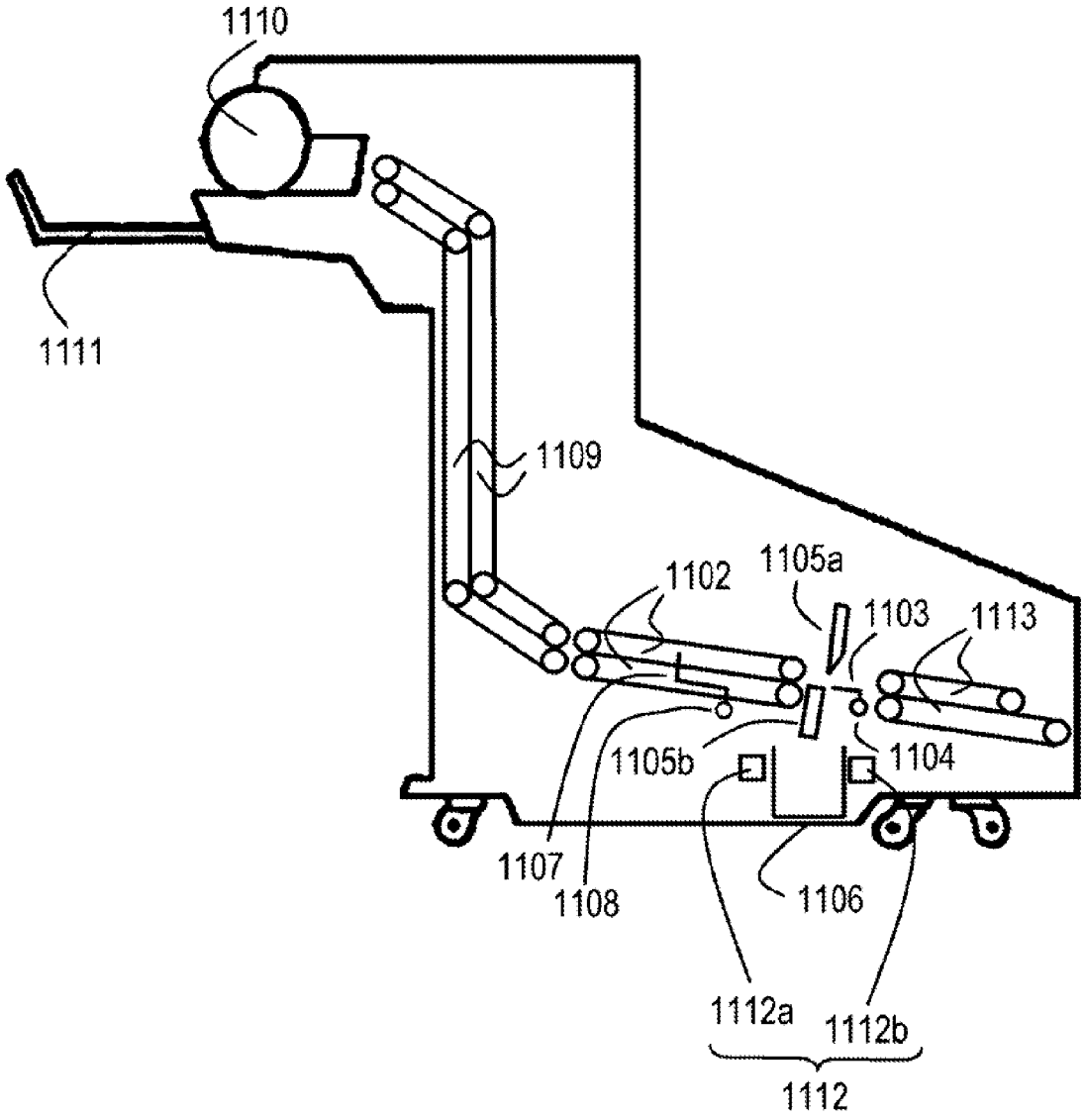
FIG. 12 is a longitudinal cross-sectional front view illustrating a trimmer portion.

The scraps stacking apparatus may be used as an apparatus that stacks and stores not only punch scraps generated in the punch unit in the finisher, but also sheet scraps generated in a shearing portion 1105 of the trimmer portion 1100, illustrated in FIGS. 1 and 12.

Figure 13:
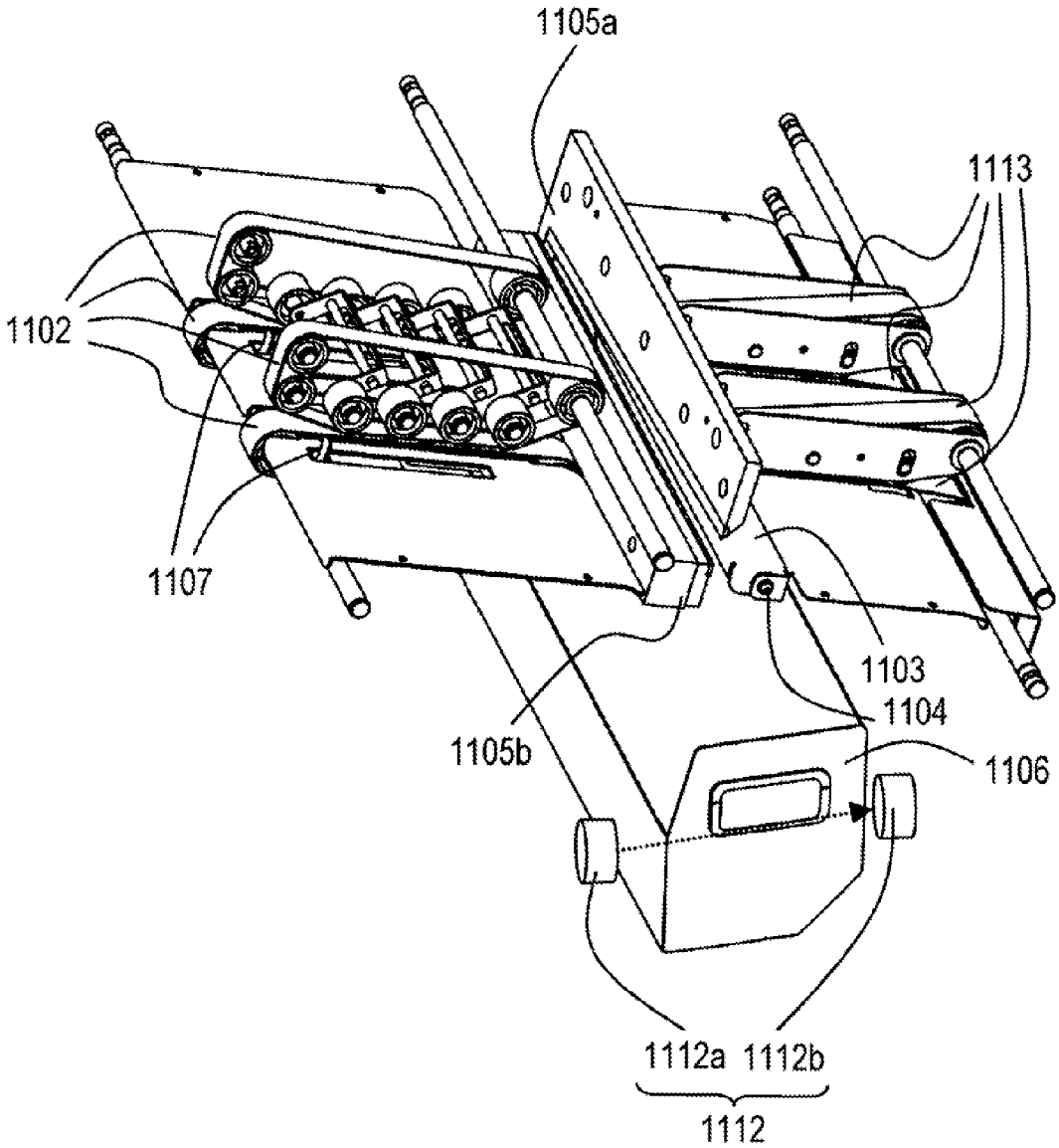
FIG. 13 is a perspective view illustrating a shearing portion.

Referring to FIGS. 12 and 13, the following description will discuss the scrap stacking apparatus that is applied to the trimmer portion 1100. Each of the saddle-stitch bundles discharged from the pair of second fold conveying rollers 812*a* and 812*b* of the saddle-stitch bookbinding portion 800 is received by pair of conveyers 1113 of the trimmer portion 1100, with the end portion (back portion) on the saddle-stitched side forming a leading edge. The saddle-stitch bundle, conveyed by the pair of conveyers 1113, is further conveyed to pair of conveyers 1102, passing over a rocking path 1103 and a lower blade 1105*b*. The saddle-stitch bundle, conveyed to the pair of conveyers 1102, is further conveyed until the end portion (back portion) on the saddle-stitched side has abutted against a tip stopper 1107. The saddle-stitch bundle that has abutted against the tip stopper 1107 to be positioned, is then subjected to a shearing process by falling down of an upper blade 1105*a* at its edge portion on the side opposite to the back portion. Upon completion of the shearing process, the tip stopper 1107 is allowed to pivot anticlockwise centered on a pivotal center 1108 so that the tip stopper 1107 is retracted from the conveying path of the pair of conveyers 1102. Upon completion of the retracting process, the pair of conveyers 1102 are again started to carry out the conveying operation so that the saddle-stitch bundle is passed over to pair of conveyers 1109 on the downstream side. The pair of conveyers 1109 passes the saddle-stitch bundle to a bundle-pressing roller 1110 so that the saddle-stitch bundle is then stacked on a stack tray 1111. By repeating these operations, the succeeding saddle-stitch bundles are successively subjected to the shearing process.

Sheet scraps (cut scraps), derived from the saddle-stitch bundle cut by the upper blade 1105*a* and the lower blade 1105*b* that form the shearing portion 1105, are housed in a scrap box 1106 forming a stacking portion in the scrap stacking apparatus. After shearing processes for a predetermined number of sheets, the scrap detection portion 1112 carries out a scanning process in a depth direction of the scrap box 1106 to detect the stacked state of scraps. In the same manner as in the punch scrap detection portion 537, this scrap detection portion 1112 includes an oscillation portion 1112*a* that oscillates an electromagnetic wave in a band from 30 GHz to 100 THz, and a receiving portion 1112*b*. The detection method for the stacked state of scraps by this scrap detection portion 1112 is also carried out in the same manner as in the scrap stacking apparatus of the aforementioned punch unit.

The present embodiment is described by exemplifying a shearing portion that shears the smaller edge portion of a sheet bundle bound into a book; however, the shearing portion is not intended to be limited to this structure. For example, the shearing portion may be prepared as such a portion as to shear the upper and lower end portions of the sheet bundle bound into a book, or as such a portion as to shear the smaller edge portion as well as the upper and lower end portions of the sheet bundle. That is, the present invention is effectively applied to a scrap stacking apparatus used for stacking sheet scraps (cut scraps) generated upon shearing end portions of the sheet bundle by the shearing portion.

As described above, according to the present embodiment, by using an electromagnetic wave in a band range from 30 GHz to 100 THz having a permeating characteristic through polymer materials, the electromagnetic wave oscillated from the oscillation portion is allowed to transmit through the stacking portion and sheet scraps to reach the receiving portion. With this arrangement, since there is no need for preparing incident/exit ports for the electromagnetic wave, there is no possibility of leakage of cut scraps such as sheet scraps outside of the stacking portion. Moreover, even in the case where sheet scraps have adhered to the inner wall of the stacking portion, the electromagnetic wave is positively allowed to reach the receiving portion so that the stacked state of scraps housed in the stacking portion can be detected.

The embodiment has exemplified a perforating portion having at least one or more perforating patterns, and a shearing portion that shears the smaller edge portion and the upper and lower end portions of the sheet bundle bound into a book, as a processing portion for carrying out processes on sheets; however, the present invention is not intended to be limited to these structures. For example, the processing portion may carry out a binding process on the sheet bundle by using binding tools, such as needles, or may include a cutting portion used for cutting binding margins of the binding tools according to the thickness of the sheet bundle. In this case, the resulting scraps correspond to cut scraps generated upon cutting the binding margins of the binding tools according to the thickness of the sheet bundle. The present invention is effectively applied to such a scrap stacking apparatus that stacks these scraps.

Moreover, in the above-mentioned embodiment, a copying machine has been exemplified as the image forming apparatus; however, the present invention is not intended to be limited to this. For example, other image forming apparatuses, such as scanners, printers, and facsimile machines, and multifunction machines in which these functions are combined with one another, may also be used. By applying the present invention to a sheet processing apparatus or a scrap stacking apparatus to be used for these image forming apparatuses, the same effects can be obtained.

Moreover, in the above-mentioned embodiment, a scrap stacking apparatus (to which a stacking portion is detachably attached), which has a sheet processing apparatus as an integral apparatus, has been exemplified; however, the present invention is not intended to be limited to this structure. For example, a scrap stacking apparatus, which can be detachably attached to a sheet processing apparatus, may be used, and by applying the present invention to such a scrap stacking apparatus, the same effects can be obtained. Moreover, a scrap stacking apparatus, which is used for a sheet processing apparatus that is detachably attached to an image forming apparatus, has been exemplified; however, the present invention is not intended to be limited to this structure. For example, a scrap stacking apparatus that is integrally possessed by an image forming apparatus may also be used, and by applying the present invention to such a scrap stacking apparatus, the same effects can be obtained.

According to the present invention, by using an electromagnetic wave in a band range from 30 GHz to 100 THz that has a permeating characteristic through polymer materials, the electromagnetic wave, oscillated from the oscillation portion, is allowed to reach the receiving portion after passing through the stacking portion and sheet scraps. With this arrangement, since there is no need for preparing incident/exit ports for the electromagnetic wave, there is no possibility of leakage of cut scraps such as sheet scraps outside of the stacking portion. Moreover, even in the case where sheet scraps have adhered to the inner wall of the stacking portion, the electromagnetic wave is positively allowed to reach the receiving portion so that the stacked state of scraps housed in the stacking portion can be detected.

While the present invention has been described with reference exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-295865, filed Dec. 25, 2009, which is hereby incorporated by reference herein in its entirety.

What is claimed is:

1. A scrap stacking apparatus comprising:

a stacking portion in which scraps, generated in at least one processing portion that carries out processes on sheets, are stacked;

an oscillation portion that is placed out of the stacking portion, and generates an electromagnetic wave; and a receiving portion that is placed out of the stacking portion, and receives the electromagnetic wave oscillated by the oscillation portion through the stacking portion, wherein the oscillation portion generates an electromagnetic wave in a band from 30 GHz to 100 THz, and the electromagnetic wave, oscillated by the oscillation portion, is received by the receiving portion through the stacking portion so that a stacked state of the scraps housed in the stacking portion is detected.

2. The apparatus according to claim 1, wherein the at least one processing portion is a perforating portion that has at least one or more perforation patterns and the scraps are perforation scraps generated by perforating operations of the perforating portion.

3. The apparatus according to claim 1, wherein the at least one processing portion is a shearing portion that shears an end portion of a sheet bundle bound into a book, and the scraps are sheet scraps generated by the shearing operations of the shearing portion.

4. The apparatus according to claim 1, wherein the at least one processing portion carries out a binding process for binding a sheet bundle with a binding tool, and includes a cutting portion which cuts binding margins of the binding tool according to the thickness of the sheet bundle, and the scraps are cut scraps generated upon cutting the binding margins of the binding tool according to the thickness of the sheet bundle.

5. The apparatus according to claim 1, wherein the stacking portion is made from a material that allows the electromagnetic wave oscillated by the oscillation portion to transmit therethrough.

6. The apparatus according to claim 1, wherein the receiving portion receives an attenuation of the amplitude of the electromagnetic wave caused upon transmitting through the stacking portion and the scraps so that the stacked state of the scraps stacked in the stacking portion is detected.

7. The apparatus according to claim 1, wherein the oscillation portion and the receiving portion, which are disposed face to face with each other, with the stacking portion being interposed therebetween, carry out a scanning process on the stacking portion so that the stacked state of the scraps housed in the stacking portion in a scanning direction is detected.

8. The apparatus according to claim 1, further comprising a vibrating portion which levels the scraps stacked in the stacking portion, wherein, in the case where the amplitude of the received electromagnetic wave has an amount of deviations exceeding a predetermined value, the vibrating portion is operated.

9. The apparatus according to claim 1, further comprising a stirring portion which levels the scraps stacked in the stacking portion, wherein, in the case where the amplitude of the received electromagnetic wave has an amount of deviations exceeding a predetermined value, the stirring portion is operated.

10. A sheet processing apparatus comprising:

a processing portion that carries out processes on a sheet; and a scrap stacking apparatus that stacks scrap generated in the processes carried out by the processing portion, wherein the scrap stacking apparatus includes:

a stacking portion in which scraps, generated in the processing portion that carries out the processes on sheets, are stacked;

an oscillation portion that is placed out of the stacking portion, and generates an electromagnetic wave; and a receiving portion that is placed out of the stacking portion, and receives the electromagnetic wave oscillated by the oscillation portion through the stacking portion, wherein the oscillation portion generates an electromagnetic wave in a band from 30 GHz to 100 THz, and the electromagnetic wave, oscillated by the oscillation portion, is received by the receiving portion through the stacking portion so that a stacked state of the scraps housed in the stacking portion is detected.

11. The apparatus according to claim 10, wherein the processing portion is a perforating portion that has at least one or more perforation patterns and the scraps are perforation scraps generated by perforating operations of the perforating portion.

12. The apparatus according to claim 10, wherein the processing portion is a shearing portion that shears an end portion of a sheet bundle bound into a book, and the scraps are sheet scraps generated by the shearing operations of the shearing portion.

13. The apparatus according to claim 10, wherein the processing portion carries out a binding process for binding a sheet bundle with a binding tool, and includes a cutting portion which cuts binding margins of the binding tool according to the thickness of the sheet bundle, and the scraps are cut scraps generated upon cutting the binding margins of the binding tool according to the thickness of the sheet bundle.

14. The apparatus according to claim 10, wherein the stacking portion is made from a material that allows the electromagnetic wave oscillated by the oscillation portion to transmit therethrough.

15. The apparatus according to claim 10, wherein the receiving portion receives an attenuation of the amplitude of the electromagnetic wave caused upon transmitting through the stacking portion and the scraps so that the stacked state of the scraps housed in the stacking portion is detected.

16. The apparatus according to claim 10, wherein the oscillation portion and the receiving portion, which are disposed face to face with each other, with the stacking portion being interposed therebetween, carry out a scanning process on the stacking portion so that the stacked state of the scraps housed in the stacking portion in a scanning direction is detected.

17. The apparatus according to claim 10, wherein the scrap stacking apparatus further includes a vibrating portion which levels the scraps stacked in the stacking portion, wherein, in the case where the amplitude of the received electromagnetic wave has an amount of deviations exceeding a predetermined value, the vibrating portion is operated.

18. The apparatus according to claim 10, wherein the scrap stacking apparatus further includes a stirring portion which levels the scraps stacked in the stacking portion, wherein, in the case where the amplitude of the received electromagnetic wave has an amount of deviations exceeding a predetermined value, the stirring portion is operated.

* * * * *